US005160415A

United States Patent [19]

Kondo et al.

[11] Patent Number: 5,160,415

[45] Date of Patent: Nov. 3, 1992

[54] CARBON ELECTRODE, AND METHOD AND APPARATUS FOR THE ELECTROLYSIS OF A HYDROGEN FLUORIDE-CONTAINING MOLTEN SALT WITH THE CARBON ELECTRODE

[75] Inventors: Teruhisa Kondo, Toyonaka; Tetsuro Tojo, Kyoto; Nobuatsu Watanabe, Nagaokakyo, all of Japan

[73] Assignee: Toyo Tanso Co., Ltd., Osaka, Japan

[21] Appl. No.: 650,536

[22] Filed: Feb. 5, 1991

[30] Foreign Application Priority Data

Feb. 6, 1990 [JP] Japan ..... 2-25274

[51] Int. Cl.[5] ..... C25B 1/24; C25B 9/00; C25B 11/12

[52] U.S. Cl. ..... 204/60; 204/294; 204/243 R

[58] Field of Search ..... 204/29, 60, 243 R

[56] References Cited

U.S. PATENT DOCUMENTS 5,069,764 12/1991 Watanabe et al. ..... 204/60

FOREIGN PATENT DOCUMENTS 39-11457 6/1964 Japan .

*Primary Examiner*—Donald R. Valentine

*Attorney, Agent, or Firm*—Armstrong & Kubovcik

[57] ABSTRACT

A carbon electrode is disclosed comprising a porous carbon block and having a flexural strength of at least 50 MPa and exhibiting, on a linear sweep voltammogram obtained by subjecting the carbon electrode to potential sweep in concentrated sulfuric acid at 25° C., a peak having a maximum current density at a potential of at level 1.2 V. This carbon electrode is substantially free from the danger of destruction and the danger of local breakage and partial coming-off and can advantageously be used as an anode not only for stably conducting the electrolysis of an HF-containing molten salt but also for producing a desired electrolysis product with high purity.

5 Claims, 3 Drawing Sheets

CARBON ELECTRODE, AND METHOD AND APPARATUS FOR THE ELECTROLYSIS OF A HYDROGEN FLUORIDE-CONTAINING MOLTEN SALT WITH THE CARBON ELECTRODE

BACKGROUND OF THE INVENTION

1. Field of the Invention

The present invention relates to a carbon electrode. More particularly, the present invention is concerned with a carbon electrode not only having excellent mechanical strength but also being chemically stable so that even when the carbon electrode is used as an anode in the electrolysis of an HF-containing molten salt (in this electrolysis the carbon electrode is exposed to a fluorine atmosphere entraining HF and therefore is likely to form an intercalation compound with fluorine and hydrogen fluoride, which has for the first time been found by the present inventors to be a cause of cracking of a carbon electrode), the carbon electrode is substantially free from the danger of breakage or cracking during the electrolysis. The carbon electrode of the present invention can advantageously be utilized not only for stably conducting the electrolysis of an HF-containing molten salt but also for obtaining an electrolysis product of high purity. The present invention is also concerned with a method and an apparatus for the electrolysis of a hydrogen fluoride (HF)-containing molten salt by the use of this carbon electrode as an anode.

2. Discussion of Related Art

As a representative example of electrolysis of an HF-containing molten salt, electrolytic production of fluorine can be mentioned. As a method for producing fluorine, the so-called middle temperature method, in which the electrolysis of a molten salt composed of KF and HF is conducted at about 90° C., is generally employed.

In the case of the middle temperature method, KF-2HF is widely used as the composition for a molten salt electrolytic bath since, with this composition, the vapor pressure of HF is low at a temperature around the melting point of the molten salt and, in addition, the melting point of the molten salt is substantially not affected by a change in the HF concentration of the bath. As the material for the anode of the electrolytic cell, carbon is mainly employed since a metal cannot be used due to the danger of melting of a metallic anode during the electrolysis. As the material for the cathode, various metals, such as iron, steel, nickel and Monel metal, can be employed on a laboratory scale, but iron is usually used in a commercial-scale electrolysis from the viewpoint of availability and economy. The electrolysis is generally conducted under conditions such that the current density is 7 to 13 $A/dm^2$ and the bath voltage is 8.5 to 15 V.

The anode and cathode reactions which should occur in the electrolysis using the above method can be represented by the following formulae (1) and (2), respectively:

$$\text{(Anode reaction) } (HF)nF^- \longrightarrow \tfrac{1}{2}F_2 + nHF + e^- \quad (1)$$

$$\text{(Cathode reaction) } H^+(HF)n + e^- \longrightarrow \tfrac{1}{2}H_2 + nHF \quad (2)$$

It is known that when a carbon electrode is used as an anode in the electrolytic production of fluorine, the carbon electrode suffers the following serious problems (a), (b) and (c):

(a) One end portion of a carbon electrode, which is usually fixedly connected to a positive terminal for flowing an electric current to the anode in an electrolytic apparatus by means of a copper bolt and a copper nut, is likely to be largely destroyed at this portion of connection during the electrolysis.

(b) The mechanical strength of a porous carbon electrode is generally low, so that local breakage and gradual, partial coming-off of the carbon electrode are likely to occur during the electrolysis, even at portions other than the above-mentioned portion of connection, thereby producing fine particles of carbon. (Herein, "gradual, partial coming-off" means gradual, partial loss of a carbon electrode as carbon particles broken from the almost entire surface thereof.) These fine particles of carbon easily react with fluorine to thereby form $CF_4$, and the resultant $CF_4$ is disadvantageously contained in the fluorine as the desired electrolysis product.

(c) Due to the reaction between the carbon anode and $F_2$ evolved at the carbon anode, a film of graphite fluoride having an extremely low surface energy is formed on the carbon electrode to cover the electrode. The wettability of the carbon electrode for the electrolytic bath is decreased at portions where graphite fluoride has been formed, so that the carbon electrode becomes electrochemically inactive at these graphite fluoride-covered portions. The effective surface area of the carbon electrode is decreased in accordance with the increase in the graphite fluoride-coverage ratio of the surface of the carbon electrode, and thus, the true current density on the carbon electrode is increased. This is the main cause of the anodic overvoltage observed in the electrolytic production of fluorine, and when the graphite fluoride-coverage of the carbon electrode exceeds 20% of the surface area, an abrupt, spontaneous rise of voltage is observed and it becomes no longer possible to flow an electric current through the carbon electrode. This phenomenon, which is known as the "anode effect", is a great problem encountered in commercially conducting the electrolysis of an HF-containing molten salt.

Among the above-described problems (a), (b) and (c), problem (c) has already been successfully solved by the present inventors by developing a method in which a metal fluoride mixture containing LiF is effectively introduced into the pores of a carbon block by skillful impregnation, thereby suppressing the occurrence of the anode effect during the electrolysis (see European Patent Application Publication No. 0 354 057).

However, the above-mentioned problems (a) and (b) (that is, destruction of the carbon electrode at its portion connected to the positive terminal for flowing an electric current to the anode as well as local breakage and gradual, partial coming-off of the carbon electrode) have not yet been solved, and have been of extreme seriousness in conducting the electrolysis of an HF-containing molten salt on a commercial scale. Therefore, development of a carbon electrode which is free from the above problems so that the electrolysis of an HF-containing molten salt can be stably performed for a prolonged period of time while assuring a high purity of a desired electrolysis product, has been earnestly desired.

In general, a carbon electrode comprises a porous carbon block which is prepared by a method in which coke, such as petroleum coke and pitch coke, is pulverized to prepare a base material and the base material is then blended with a binder, such as a coal-tar pitch and a synthetic resin, and the resultant blend is subjected to kneading, molding and heat treatment. The coke to be used in the above method as the base material has regions in which the crystallites of graphite are oriented in a certain direction at least to some degree. These crystallites of graphite grow and develop when the temperature is increased for heat treatment.

As a result of the intensive studies of the present inventors, it has been found that not only does a lower mechanical strength, such as a lower flexural strength, of a carbon electrode cause local breakage and gradual, partial coming-off of the carbon electrode, the chemical behavior, which is exhibited during the electrolysis of an HF-containing molten salt, of the above-mentioned graphite structure regions of the carbon electrode has close connection with the destruction of a portion of the carbon electrode where the carbon electrode is fixedly connected to the positive terminal which is positioned above the level of the electrolytic bath. That is, the present inventors have unexpectedly found that when a carbon electrode is exposed to an $F_2$ atmosphere entraining HF, an intercalation compound is likely to be formed by a reaction represented by formula (3) shown below:

$$xC + \tfrac{1}{2}F_2 + HF \longrightarrow Cx^{+}HF_2^{-} \quad (3)$$

and that due to the formation of the intercalation compound, the interlayer spacings of the graphite structure are widened to expand the carbon electrode, leading to a destruction of the carbon electrode.

SUMMARY OF THE INVENTION

The present inventors have made extensive and intensive studies with a view toward solving the problems accompanying the prior art and toward developing a carbon electrode which is free from the danger of destruction due to the formation of an intercalation compound and the danger of local breakage and gradual, partial coming-off when the carbon electrode is used as an anode in the electrolysis of an HF-containing molten salt. As a result, it has unexpectedly been found that when the carbon electrode satisfies two requirements such that it must have a flexural strength higher than a specific level and that it must exhibit, on a linear sweep voltammogram obtained by subjecting the carbon electrode to potential sweep under specific conditions, a peak at a potential higher than a specific level, the carbon electrode is free from the above-mentioned problems accompanying the conventional carbon electrode and can advantageously be used as an anode not only for stably conducting the electrolysis of an HF-containing molten salt but also for obtaining an electrolysis product of high purity. The present invention has been completed on the basis of these novel findings.

It is, therefore, an object of the present invention to provide a carbon electrode which is free from the danger of destruction at a portion connected to a positive terminal for flowing an electric current to an anode in an electrolytic apparatus and the danger of local breakage and gradual, partial coming-off when the carbon electrode is used as an anode in the electrolysis of an HF-containing molten salt.

It is another object of the present invention to provide a method for the electrolysis of an HF-containing molten salt using as an anode the above-mentioned carbon electrode, which can stably be performed to obtain a product having high purity.

It is still another object of the present invention to provide an apparatus for electrolyzing an HF-containing molten salt, in which use is made of the above-mentioned carbon electrode as the anode, thereby enabling a prolonged operation of the electrolysis without the need of replacement of the carbon electrode as an anode.

The foregoing and other objects, features and advantages of the present invention will be apparent from the following detailed description and appended claims taken in connection with the accompanying drawings.

DETAILED DESCRIPTION OF THE INVENTION

Figure 1:
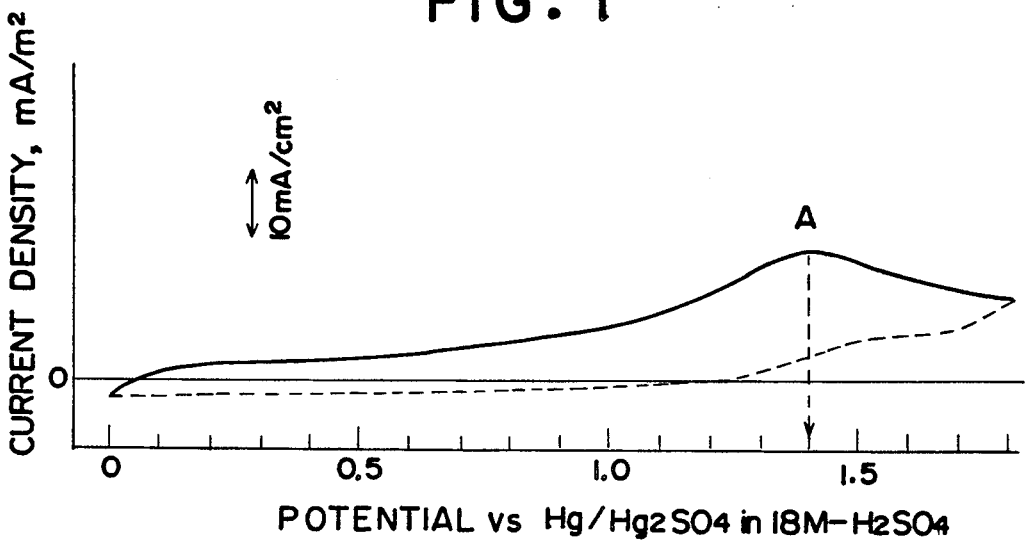
FIG. 1 shows a linear sweep voltammogram obtained by subjecting the carbon electrode of the present invention to potential sweep in concentrated sulfuric acid at a sweep rate of 5 mV/sec. at 25° C.

In one aspect of the present invention, there is provided a carbon electrode comprising a porous carbon block and having a flexural strength of at least 50 MPa and exhibiting, on a linear sweep voltammogram obtained by subjecting the carbon electrode to potential sweep in concentrated sulfuric acid at a sweep rate of 5 mV/sec. at 25° C., a peak having a maximum current density at a potential of at least 1.2 V relative to the potential of mercuric sulfate as a standard electrode.

The characteristic features of the carbon electrode of the present invention will now be described.

In a carbon product, the growth of graphite crystals cannot easily progress not only beyond the boundary of each particle of carbon but also beyond the amorphous portions surrounding the region in which the graphite crystallites of the crystal are orientated. The present inventors have found that orientation of graphite crystallites in a carbon product can be effectively suppressed by a method in which a carbon product is produced by pulverizing coke as a base material to a size as small as several microns or tens of microns and adding a relatively large amount of pitch as a binder to the pulverized coke as a base material. The present inventors have also found that the growth of graphite crystals can be effectively restricted by using as the base material either a coke having a fine mosaic structure or a fine particulate material, such as mesophase microbeads having a particle diameter of a size as small as several microns, and that a carbon block in which growth of graphite crystals has been restricted is not susceptive to an intercalation compound-forming reaction represented by formula (3) mentioned above. In this connection, it should be noted that for restricting the growth of graphite crystals, it is desired to control the temperature of the heat treatment for forming a carbon block to a level as low as possible.

The insusceptibility of a carbon block to an intercalation compound-forming reaction can be assessed by the potential at which the carbon electrode exhibits a peak having a maximum current density on a linear sweep voltammogram obtained by subjecting the carbon electrode to potential sweep in concentrated sulfuric acid (with mercuric sulfate employed as a standard electrode). The peak is ascribed to the formation of a first-stage intercalation compound of the carbon with the sulfuric acid.

The reaction occurring in concentrated sulfuric acid for the formation of an intercalation compound of a carbon material is presented by formula (4) shown below:

$$xC+3H_2SO_4 \rightarrow C_x^+HSO_4^-2H_2SO_4+H^++e^- \quad (4)$$

In the formation of an intercalation compound in accordance with formula (4), the interlayer spacings of the graphite structure are expanded and the concentrated sulfuric acid diffuses into the interlayer spacings as an intercalant during the potential sweep for obtaining a linear sweep voltammogram. When the degree of development of the graphite crystallites is low, the activation energy necessary for the above-mentioned expansion and diffusion is large, so that the potential necessary for forming a graphite intercalation compound becomes noble as compared to that exhibited in the case of a carbon material in which the degree of development of the graphite crystallites is high. That is, the higher the potential at which a carbon electrode exhibits a peak having a maximum current density (the peak being ascribed to the formation of a first-stage intercalation compound of the carbon with the sulfuric acid) on a linear sweep voltammogram obtained with respect to the carbon electrode, the less likely the carbon electrode is susceptive to formation of an intercalation compound.

It is requisite that the carbon electrode of the present invention exhibit, on a linear sweep voltammogram obtained by subjecting the carbon electrode to potential sweep in concentrated sulfuric acid at a sweep rate of 5 mV/sec. at 25° C., a peak having a maximum current density at a potential of at least 1.2 V relative to the potential of mercuric sulfate as a standard electrode (the potential at which the carbon electrode exhibits the peak is hereinafter frequently referred to simply as "peak potential"). As mentioned above, the peak is ascribed to the formation of a first-stage intercalation compound of the carbon with the sulfuric acid. The formation of a first-state intercalation compound can be confirmed by stopping the sweep when a peak is reached, and subjecting the carbon electrode to X-ray diffractometry. Only when the peak potential is at least 1.2 V, destruction [i.e., problem (a) described before] of a carbon electrode by expansion of the electrode due to the formation of an intercalation compound during the electrolysis operation, can be prevented. The peak potential is preferably at least 1.3 V.

On the other hand, when a carbon electrode suffers local breakage and gradual, partial coming-off [i.e., problem (b) described above] due to the low mechanical strength thereof, broken pieces and particles of carbon are suspended in the electrolytic bath. These broken pieces and particles of carbon, which are not only active but also have a great surface area, readily reacts with $F_2$ gas, thereby forming gaseous $CF_4$. Thus, a desired electrolysis product, such as $F_2$, disadvantageously contains the undesired $CF_4$. For preventing the above problem, it is necessary that the carbon electrode comprise a carbon block having high mechanical strength. Therefore, it is requisite that the carbon electrode of the present invention have a flexural strength of at least 50 MPa. The flexural strength of the carbon electrode of the present invention is preferably at least 55 MPa, more preferably at least 80 MPa.

A carbon material which satisfies the above-mentioned two requirements can be obtained, for example, by a method in which a pitch as a binder is used in an amount as large as at least about the same as the amount of a fine-powdery coke as a base material so that the amount of the binder coke in the final carbon block is increased; a method in which use is made of a base material susceptive to large shrinkage upon heat treatment, such as a coke having a fine mosaic structure and a raw coke so that the final carbon block can have a dense structure; or a method in which use is made of a one-component material having a structure in which a base material and a binder are integrally formed with each other, such as a modified pitch and mesophase microbeads.

The term "fine mosaic structure" used herein means a structure in which particles having a particle size of 10 μm or less are uniformly dispersed in an isotropic matrix in a mosaic pattern, which structure is obtained in the course of the formation of mesophase microspheres by heating pitch. When a carbon material having such a structure is heated, the mosaic particle portions largely shrink so that a carbon material having a high density is obtained.

On the other hand, as described above, mesophase microbeads, which can be obtained by isolating mesophase microspheres formed from pitch, can advantageously be employed as a one-component material for producing the electrode of the present invention.

When pitch is subjected to dry distillation in a controlled atmosphere, a non-graphitizable carbon material (in the case of an air atmosphere) or a precursor of an easily graphitizable carbon material (in the case of a nitrogen gas atmosphere) is obtained. These carbon materials are known as modified pitch, and can advantageously be used as a one-component material for producing the carbon electrode of the present invention.

Illustratively stated, the carbon electrode of the present invention can be produced, for example, by a method in which a two-component material comprising 100 parts by weight of a calcined coke (as a base material) in the form of fine particles having a particle diameter of 3 to 20 μm and about 80 to 130 parts by weight of a pitch as a binder (such as, coal-tar pitch and petroleum pitch) or a one-component material, such as modified pitch and mesophase microbeads, is subjected to heat treatment to thereby obtain a carbon material, and the resultant carbon material is cut into a block. The temperature for the heat treatment is generally in the range of from 1000° to 1500° C., preferably in the range of from 1000° to 1200° C. from the viewpoint of the desired mechanical strength and the prevention of the formation of an intercalation compound during the electrolysis using the carbon block as an anode. The thus obtained carbon block is porous but has a dense structure as compared to the conventional carbon electrode, that is, it has a porosity of about 2 to about 10% and the average pore diameter thereof is very small, for example, about 1 μm or so.

As mentioned above, in the present invention, it is requisite that the flexural strength of the carbon electrode be at least 50 MPa as measured by a 3-point flexural test (JIS R7222) in which a test sample is supported at two points with a distance of 40 to 80 mm therebetween and downwardly loaded at a point middle the two points. The flexural strength is preferably at least 55 MPa, more preferably at least 80 MPa. When a carbon electrode satisfying the above-mentioned flexural strength requirement is used as an anode in the electrolysis of an HF-containing molten salt, for example, in the electrolysis of a molten salt of a KF-HF system, such as a KF-2HF salt, for producing fluorine, the evolution of the undesired $CF_4$ gas can be suppressed to the level of only a trace.

As already described, in the present invention, it is requisite that the carbon electrode satisfy both of the two requirements of having a flexural strength of at least 50 MPa and exhibiting, on a linear sweep voltammogram obtained by subjecting the carbon electrode to potential sweep in concentrated sulfuric acid at a sweep rate of 5 mV/sec. at 25° C., a peak having a maximum current density at a potential of at least 1.2 V relative to the potential of mercuric sulfate as a standard electrode. Only when both of the above two requirements are satisfied, not only the danger of destruction of the carbon electrode at its portion connected to the positive terminal for flowing an electric current to the anode but also the danger of local breakage and gradual, partial coming-off of the carbon electrode can be minimized in the electrolysis of an HF-containing molten salt so that the electrolysis operation can be stably conducted while attaining a high purity of the desired electrolysis product. The object of the present invention cannot be attained when any one of these two requirements is not satisfied.

In another preferred embodiment of the present invention, the carbon electrode further comprises at least one metal fluoride contained in the pores of the porous carbon block in order to suppress the occurrence of the anode effect as mentioned above. Examples of suitable metal fluorides include LiF, NaF, CsF, $AlF_3$, $MgF_2$, $CaF_2$ and $NiF_2$. These metal fluorides can be individually introduced into the pores of the carbon block under high temperature and high pressure conditions. However, from the viewpoint of smooth and effective introduction into the pores of a carbon block, it is preferred that the metal fluorides be introduced in the form of a mixture of a plurality of metal fluorides. This is because the surface tension of a metal fluoride mixture which is in a molten state is lower than the surface tension of an individual metal fluoride which is in a molten state. As especially preferred combinations of metal fluorides, a combination of $AlF_3$ and NaF and a combination of LiF and NaF can be mentioned. The molar ratio is not particularly limited, but generally the preferred molar ratio of $AlF_3$ to NaF is about 3/1 to about 3/2 and the preferred molar ratio of LiF to NaF is about 0.5/1 to about 2/1. The use of NaF in combination with another metal fluoride is preferred because NaF easily reacts with ferric fluoride (which is formed due to the dissolution of the iron from iron-made equipments of the electrolytic apparatus and causes the electrolytic bath to disadvantageously viscous) to form a complex ($NaFFeF_3$) which will precipitate, so that the undesired effect of the ferric ions can be eliminated.

When a carbon block is impregnated with at least one metal fluoride, the metal fluoride is contained in the fine pores of the carbon block. It has unexpectedly been found that a carbon block which has been impregnated with at least one metal fluoride is greatly improved with respect to flexural strength.

With respect to the method for introducing a metal fluoride (or mixture) into the pores of a porous carbon block, there is no particular limitation as long as the metal fluoride (or mixture) is introduced into the pores of the porous carbon block at a packing ratio of at least 30%, preferably at a packing ratio of at least 50%, more preferably at a packing ratio of 65% or more.

For example, the introduction of the metal fluoride (or mixture) into the pores of the carbon block can easily be conducted by heating the metal fluoride (or mixture) to a temperature of not lower than the melting temperature thereof to obtain a molten metal fluoride (or mixture); contacting the carbon block with the molten metal fluoride (or mixture) under a predetermined superatmospheric pressure to thereby introduce the molten metal fluoride (or mixture) into the pores of the carbon block; and cooling the resultant carbon block having the molten metal fluoride (or mixture) contained in the pores thereof to a predetermined temperature, usually room temperature. In the above method, by controlling the value of the superatmospheric pressure under which the porous carbon block is contacted with the molten metal fluoride (or mixture), a desired packing ratio of the metal fluoride (or mixture) introduced in the pores of the carbon block can be attained.

The above method will be described hereinbelow in more detail. For example, a metal fluoride mixture composed of $AlF_3$ and NaF at a molar ratio $AlF_3$/NaF of 3/1 is prepared. The above mixture is heated to, for example, 970° to 1050° C. in a crucible to obtain a molten metal fluoride mixture, and then, a porous carbon block is put in the crucible, thereby contacting the porous carbon block with the molten mixture. Alternatively, the porous carbon block may be put into a crucible together with a metal fluoride mixture before heating, followed by heating the metal fluoride mixture together with the porous carbon block to melt the metal fluoride mixture. Then, the porous carbon block is immersed in the molten metal fluoride mixture by means of pressing means made of carbon material, and held as it is immersed. The crucible is placed in a pressure vessel and the internal atmosphere of the vessel is replaced by nitrogen gas or argon gas, followed by heating at a temperature elevation rate of about 5° to 10° C./minute to about 1000° C. The internal pressure of the vessel is then reduced to 10 to 50 mmHg. The reduction of pressure is conducted not only for removing the air contained in the pores of the porous carbon block, thereby facilitating the introduction of the molten mixture into the pores of the porous carbon block, but also for preventing the porous carbon block from being oxidized. Next, an inert gas, such as nitrogen and argon, is introduced into the pressure vessel until the internal pressure reaches 50 to 100 kg/cm$^2$, and the immersion of the porous carbon block in the molten metal fluoride mixture is maintained under that pressure for a period of about 30 minutes to about 2 hours. Subsequently, the carbon block is taken out of the pressure vessel, and left in the atmosphere to cool to the ambient temperature, thereby obtaining a preferred form of a carbon electrode of the present invention, comprising the porous carbon block and, contained in the pores of the porous carbon block, the metal fluoride mixture composed of $AlF_3$ and NaF.

The terminology "the packing ratio (X)" herein used is intended to mean the ratio (%) of the pore volume of the pores of the porous carbon block which are packed with a metal fluoride (or mixture), relative to the entire pore volume (100%) of the original porous carbon block. The packing ratio can be calculated from the formula:

$$B=A+XPA'$$

wherein A is the bulk density of the porous carbon block, A' is the true density of the porous carbon block, P is the porosity of the porous carbon block, B is the specific gravity of the carbon electrode having contained therein a metal fluoride (or mixture) and X is the packing ratio of the metal fluoride (or mixture).

The porosity is measured by means of a mercury porosimeter.

By the use of the carbon electrode of the present invention, the electrolysis of an HF-containing molten salt can be stably performed.

Accordingly, in another aspect of the present invention, there is provided a method for the electrolysis of an HF-containing molten salt, comprising electrolyzing an electrolytic bath containing an HF-containing molten salt using as an anode the carbon electrode of the present invention, the HF-containing molten salt being of a KF-HF system, a CsF-HF system, an NOF-HF system, a KF-$NH_4F$-HF system or an $NH_4F$-HF system.

In the method of the present invention, when the HF-containing molten salt is of a KF-HF system (preferably a KF-2HF salt), a CsF-HF system or an NOF-HF system (preferably an NOF-3HF salt), the electrolysis product to be obtained is fluorine, while when the HF-containing molten salt is of a KF-$NH_4F$-HF system or an $NH_4F$-HF system, the electrolysis product to be obtained is nitrogen trifluoride. By the method of the present invention, not only can be stably performed the electrolysis of an HF-containing molten salt, but also a desired electrolysis product having high purity is obtained.

In still another aspect of the present invention, there is provided an apparatus for electrolyzing an HF-containing molten salt and including a cell and, disposed therein, an anode and a cathode, characterized by comprising using as the anode the carbon electrode of the present invention. There is no particular limitation with respect to the material for the cathode to be used in the electrolysis method of the present invention and for the cathode used in the apparatus of the present invention, as long as the cathode is low with respect to hydrogen overvoltage and less likely to produce a fluoride. However, from the viewpoint of availability and economy, a cathode made of iron is commercially used.

The apparatus of the present invention will be described later in more detail referring to FIGS. 3 and 4.

For demonstrating the surprising effect of the present invention, the following experiment was conducted.

To 100 parts by weight of a calcined petroleum coke which had been pulverized to a size of 325 mesh (Tyler)-pass or smaller, was added 90 parts by weight of coal-tar pitch, and the resultant blend was kneaded for a satisfactorily long period of time at an elevated temperature of about 150° to 250° C., preferably about 180° to 220° C., while adjusting the volatile content. After the kneading, the blend was allowed to cool and then subjected to pulverization (to a size of 100 mesh (Tyler)-pass or smaller). Then, the blend was molded and heat-treated at 1000° C. to thereby obtain a carbon block [Sample (I)].

The same procedure as mentioned above, including kneading, pulverization and molding, was repeated except that the amount of the coal-tar pitch was 50 parts by weight. Then, the resultant molded material was heat-treated at 2800° C. to thereby obtain a carbon block [Sample (II)].

Sample (I) exhibited a flexural strength of 57 MPa, whereas Sample (II) exhibited a flexural strength of only 46 MPa.

With respect to each of the above-obtained Samples (I) and (II), linear sweep voltammometry was conducted in which the sample was subjected to potential sweep in 18M concentrated sulfuric acid at a sweep rate of 5 mV/sec. at 25° C. In each case, a platinum plate was used as a cathode, and an electrode of mercuric sulfate immersed in concentrated sulfuric acid was used as a standard electrode.

Figure 2:
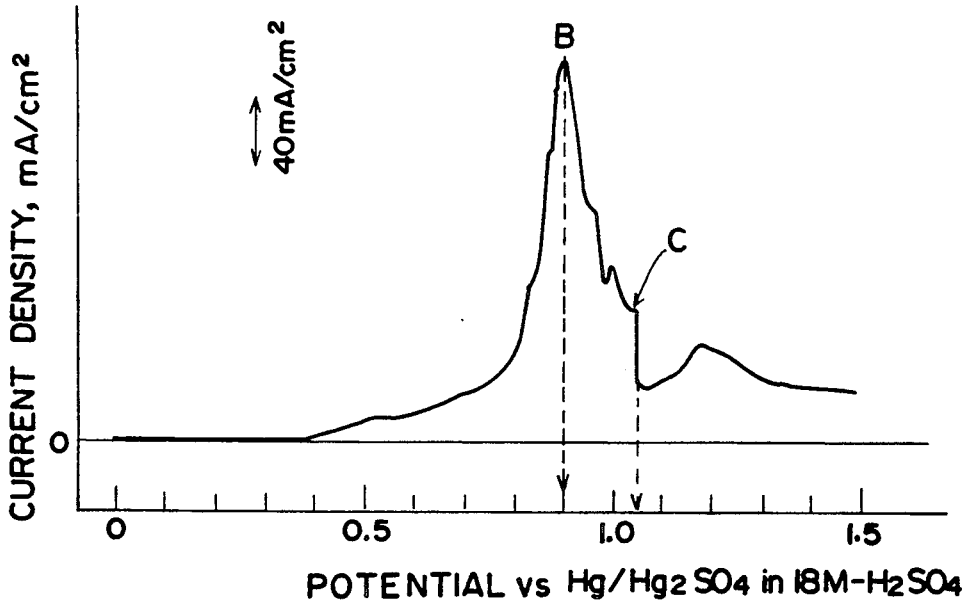
FIG. 2 (PRIOR ART)
FIG. 2 shows a linear sweep voltammogram obtained by subjecting the carbon electrode of Comparative Example 1 to potential sweep in concentrated sulfuric acid at a sweep rate of 5 mV/sec. at 25° C.

Results (i.e., linear sweep voltammograms) of the linear sweep voltammometry of Samples (I) and (II) are shown in FIG. 1 and FIG. 2, respectively.

As apparent from FIG. 1, Sample (I), which was heat-treated at 1000° C., exhibited peak (A) (peak potential) ascribed to the formation of a first-stage intercalation compound of the carbon with the sulfuric acid, at 1.4 V. As apparent from FIG. 2, Sample (II), which was relatively small with respect to the binder content and was heat-treated at 2800° C., exhibited peak (B) (peak potential) ascribed to the formation of a first-stage intercalation compound of the carbon with the sulfuric acid, at 0.9 V.

When Sample (I) (present invention) was subjected to potential sweep 50 times from 0 V to 1.5 V, no destruction or breakage of the electrode was observed. In the case of Sample (II), in the first potential sweep, the electrode expanded from its edge portions at a potential of 1.05 V (C of FIG. 2) and a portion of the electrode which was immersed in the sulfuric acid suffered great expansion so that the electrode was destroyed.

Next, using as an electrode the above-obtained two types of carbon blocks individually, electrolysis was performed by a constant current process in an electrolytic bath designed for the production of fluorine, and the performances of the electrodes were evaluated. That is, a KF-2HF salt was used as the electrolytic bath, and the carbon block (250×70×15 mm) was used as an anode and two iron plates (160×100 mm) were used as a cathode. During the electrolysis, the bath was kept at 90° C., and anhydrous hydrofluoric acid was blown into the bath so that the bath maintained a composition of KF-2HF.

For realizing a stable operation in the electrolysis, it is important to sufficiently dehydrate the bath and to employ a proper assembly of the positive terminal for flowing an electric current to the anode so as to prevent $F_2$, HF and the bath from entering the positive terminal. When the bath contains water, the carbon of the carbon block reacts with oxygen which is a discharge product of water, to thereby produce graphite oxide. Since graphite oxide is an unstable compound, it can easily react with fluorine gas evolved at the electrode, to thereby form stable graphite fluoride. Thus, when water is present in the bath even in a small amount (even 500 ppm or so), graphite fluoride is easily formed by flowing a current. According to the increase in the coverage ratio of the anode by the graphite fluoride, the ratio of electrochemically inactive sites is increased so that the true current density is elevated, leading to a disadvantageous increase in the anodic overvoltage. These reactions can be illustrated by formulae (5) and (6) shown below.

$$xC+H_2O \rightarrow C_xO \text{ (graphite oxide)}+2H^++2e^- \quad (5)$$

$$C_xO+3F^- \rightarrow C_xF \text{ (graphite fluoride)}+OF_2+3e^- \quad (6)$$

In order to sufficiently remove water from the bath, the bath was electrolyzed at a low current density using a nickel electrode to thereby evolve fluorine so as to remove water from the bath by the reaction of following formula (7).

$$2F_2+H_2O \rightarrow OF_2\uparrow+2HF \quad (7)$$

Further, a flexible graphite sheet was disposed between the positive terminal (which is made of a metal) and the carbon electrode so as to not only reduce the contact resistance but also prevent the bath, $F_2$ and HF from contacting the carbon electrode.

After the above-mentioned preparatory assembling and operation, the following electrolysis operations were conducted.

Using as an anode Sample (II) (which had been obtained by heat treatment at 2800° C. and which had a flexural strength of 46 MPa and exhibited a peak potential of 0.9 V on a linear sweep voltammogram obtained under the conditions defined above), constant-current electrolysis was conducted at 7 A/dm$^2$. As a result, in 14 days after the start of the electrolysis, the carbon electrode suffered destruction at a portion immersed in the KH-2HF bath and at a portion in contact with a bus bar. During the electrolysis, the $CF_4$ concentration of the fluorine gas evolved was monitored by gas chromatography and infrared absorption spectrometry, and as a result, it was found that the $CF_4$ concentration was constantly 500 ppm or more.

On the other hand, using as an anode Sample (I) (which had been obtained by heat treatment at 1000° C. and which had a flexural strength of 57 MPa and exhibited a peak potential of 1.4 V on a linear sweep voltammogram obtained under the conditions defined above), constant-current electrolysis was conducted at 7 A/dm$^2$. As a result, the carbon electrode suffered no destruction for 70 days after the start of the electrolysis. Further, the average $CF_4$ concentration of the fluorine gas evolved was advantageously as small as only 20 ppm.

Thus, the carbon electrode of the present invention not only has extremely high resistance to cracking so that a stable electrolysis operation can be attained, but also is extremely useful for the electrolytic production of high purity fluorine containing substantially no $CF_4$.

As described above, when the electrolytic production of fluorine is conducted in a KF-2HF bath using as an anode a carbon electrode satisfying the two requirements that the flexural strength be at least 50 MPa and that the a peak potential of at least 1.2 V be exhibited on a linear sweep voltammogram obtained under the conditions defined above, the evolution of $CF_4$ can be suppressed so that fluorine is produced with high purity and the electrolysis can be stably performed for a prolonged time without the occurrence of breakage, cracking and destruction of the electrode. Thus, the carbon electrode of the present invention exhibits great advantages in the electrolysis of a hydrogen fluoride-containing molten salt.

Figure 3:
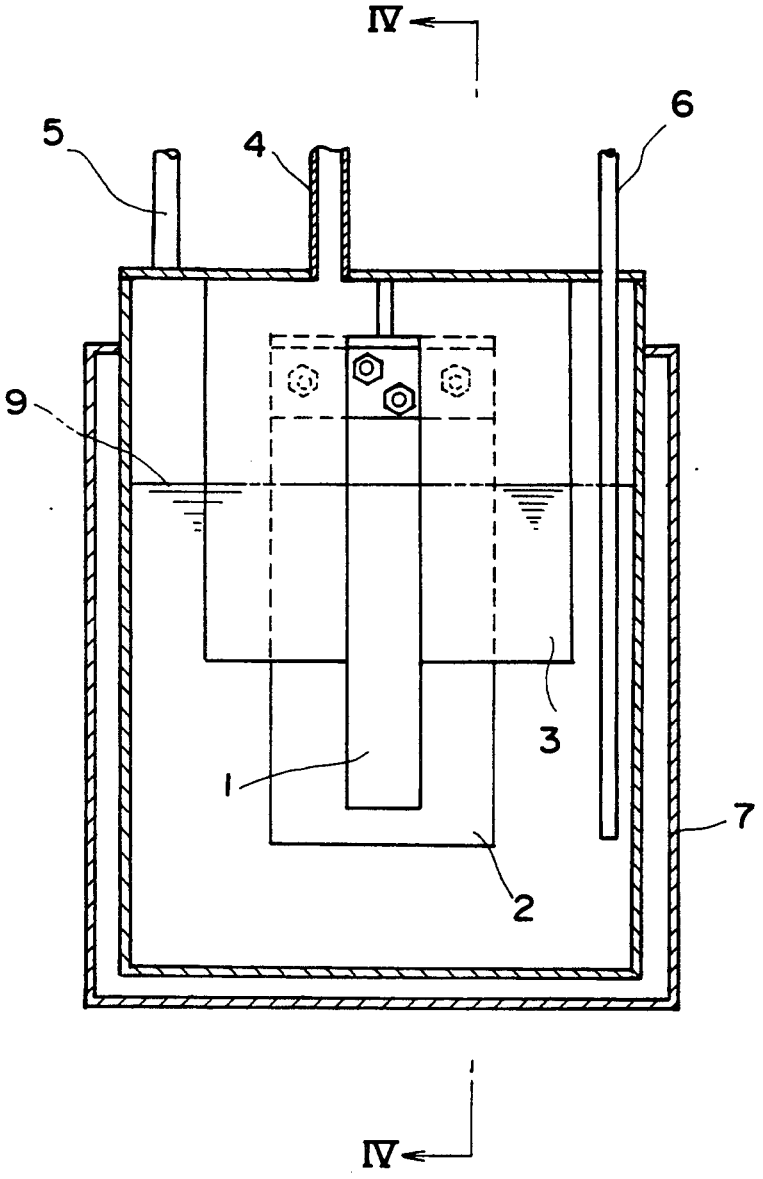
FIG. 3 is a diagrammatic cross-sectional view of one embodiment of apparatus of the present invention.
Figure 4:
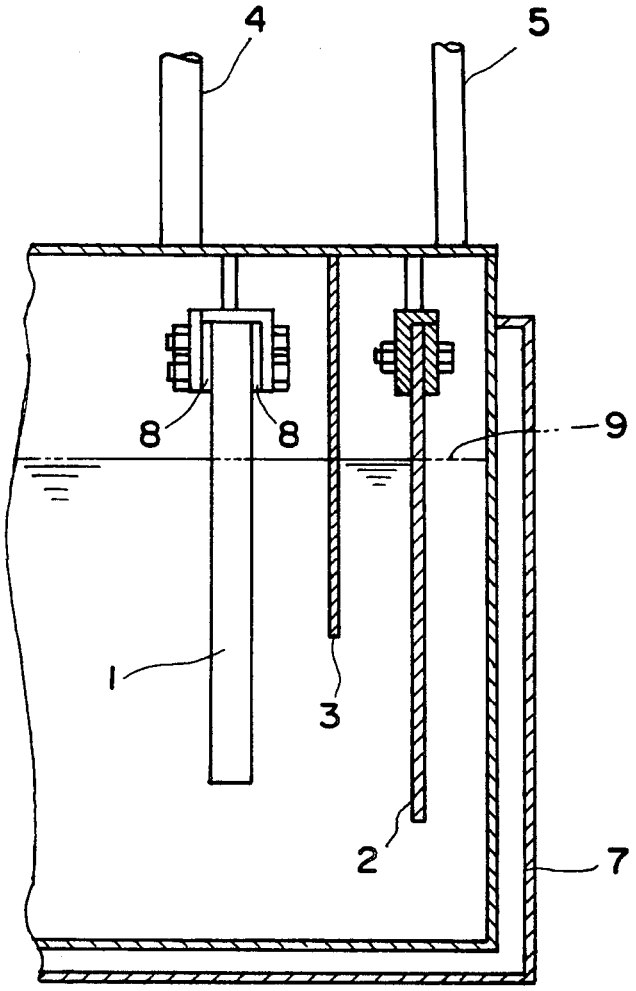
FIG. 4 is a cross-section, taken along line IV—IV of FIG. 3.

The carbon electrode of the present invention can be applied to an electrolytic apparatus as shown in FIG. 3 and FIG. 4. FIG. 3 is a diagrammatic cross-sectional view of one embodiment of the apparatus of the present invention and FIG. 4 is a cross-section taken along line IV—IV of FIG. 3. In FIG. 3 and FIG. 4, numeral 1 designates a carbon anode of the present invention and numeral 2 designates a cathode made of, for example, iron. Numeral 3 designates a skirt for preventing $F_2$ from being mixed with $H_2$, which is made of soft steel with or without Monel metal layer coated thereon. Numeral 4 designates an outlet for $F_2$, numeral 5 an outlet for $H_2$, numeral 6 (of FIG. 3) an inlet for HF and numeral 7 a hot water jacket for maintaining the electrolytic cell at 80° to 90° C. Numeral 8 (of FIG. 4) designates a flexible graphite sheet disposed between the positive terminal and the carbon electrode, which flexible sheet not only serves to seal this portion against the bath, $F_2$ and HF, but also acts as a packing for cushioning stress and prevents the increase in contact resistance. Numeral 9 designates the level of the electrolytic bath containing an HF-containing molten salt at the time of the electrolysis.

The carbon electrode of the present invention can also advantageously be used for the electrolytic production of $NF_3$, and in this case, the HF-containing molten salt is of a KF-$NH_4F$-HF system or an $NH_4F$-HF system. $NF_3$ is useful as a gas for dry etching, a gas for treating an optical fiber and a gas for washing a reaction chamber to be used for generating plasma or to be used for CVD (chemical vapor deposition), and the like.

Conventionally, when an $NH_4F$-HF salt is used for the electrolytic production of $NH_3$, a nickel electrode is employed. The reason is as follows. When a conventional carbon electrode is used for this purpose, the electrode suffers local breakage and gradual, partial coming-off during the electrolysis, thereby forming carbon particles, which in turn react with fluorine to form $CF_4$. When $CF_4$ is contained in the electrolysis product, i.e., $NF_3$, it is very difficult to separate and remove $CF_4$ since the different in the boiling point between $CF_4$ and $NF_3$ is only about 1° C. On the other hand, the conventional method using an Ni electrode is disadvantageous in that the current efficiency for the evolution of $NF_3$ is as low as about 50%.

By contrast, the carbon electrode of the present invention is free from the danger of the evolution of $CF_4$ since this carbon electrode does not suffer destruction, local breakage and/or partial coming-off (which produce carbon particles), and therefore, the use of the carbon electrode of the present invention is greatly advantageous in that $NF_3$ can be produced with high purity and at high current efficiency. With respect to an electrolytic bath for the production of $NF_3$, a molten salt of a KF-$NH_4F$-HF system as well as of an $NH_4$-HF system can advantageously be used. Especially in the case of a molten salt of a KF-$NH_4F$-HF system, a current efficiency as high as 70% or more can be attained. In the case of a molten salt of an $NH_4F$-HF system, the use of an impregnated carbon electrode is preferred.

As described, the carbon electrode of the present invention not only has excellent mechanical strength but also is substantially not susceptive to formation of an intercalation compound during the electrolysis of an HF-containing molten salt electrolyte, which intercalation compound is chemically stable and has for the first time been found to be a cause of destruction of a carbon electrode. The carbon electrode of the present invention can advantageously be utilized not only for stably conducting the electrolysis of an HF-containing molten salt but also for producing an electrolysis product of high purity.

The present invention now will be described in more detail with reference to the following Examples and Comparative Examples, which should not be construed as limiting the scope of the present invention.

EXAMPLE 1 AND COMPARATIVE EXAMPLE 1

A coke having a mosaic structure in which the optically anisotropic regions (mosaic portions) have an average size of about 10 μm, was pulverized to a size of 325 mesh (Tyler)-pass or finer, to thereby obtain a base material. To 100 parts by weight of the pulverized coke as the base material was added 90 parts by weight of a coal-tar pitch as a binder and the resultant mixture was kneaded while heating at 180° to 220° C. The mixture was then pulverized to a size of 100 mesh (Tyler)-pass or finer, to obtain a molding powder. The molding powder was molded into a rectangular parallele-piped having a size of 125×250×75 mm by means of a metal mold under a molding pressure of 800 kg/cm$^2$. The molded material was heat-treated by elevating the temperature to 1000° C. at a temperature elevation rate of 2° C./hr to obtain a carbon block (Example 1).

Substantially the same procedure as in Example 1 was repeated except that the amount of coal-tar pitch as the binder was changed to 50 parts by weight, thereby obtaining a carbon block. The resultant carbon block was further heat-treated at 2800° C. to effect graphitization. Thus, a graphitized block was obtained (Comparative Example 1).

10 pieces of test samples each having a 10×10×60 mm size were cut out from each of the above-obtained two types of blocks.

These test samples were subjected to a 3-point flexural test in which each sample was supported at two points with a distance of 40 mm therebetween and downwardly loaded at a point middle the two points. As a result, it was found that the average flexural strengths of the two types of blocks were as follows:

Example 1: 57 MPa

Comparative Example 1: 46 MPa

Further, a sample of a size of 5×30×1 mm was cut out from each of the above two types of blocks. Using these test samples individually as an anode and using a Pt plate as a cathode and mercuric sulfate as a standard electrode, potential sweep was conducted in 18M concentrated sulfuric acid at 25° C. at a sweep rate of 5 mV/sec. to obtain a linear sweep voltammogram.

FIG. 1 shows a linear sweep voltammogram obtained with respect to the electrode made of the carbon block of Example 1. A peak having a maximum current density and ascribed to the formation of a first-stage intercalation compound was observed at a potential of 1.4 V. Even when the carbon electrode was subjected to potential sweep 50 times from 0 V to 1.5 V., no destruction of the electrode was observed.

On the other hand, as shown in FIG. 2, the electrode made of the graphitized block of Comparative Example 1 exhibited a peak having a maximum current density and ascribed to the formation of a first-stage intercalation compound at a potential of 0.9 V. Further, the graphitized electrode suffered destruction in the first sweep at a potential of 1.05 V.

EXAMPLE 2 AND COMPARATIVE EXAMPLE 2

A test sample having a size of 250×70×15 mm was cut out from each of the two types of blocks obtained in Example 1 and Comparative Example 1. Using the test samples individually as an anode and using iron as a cathode, constant-current electrolysis was conducted at a current density of 7A/dm$^2$ in an electrolytic cell of 50A scale while strictly maintaining a bath temperature of 90° C. and a bath composition of KF-2HF.

The carbon electrode of Comparative Example 1 suffered destruction at its portion connected to a positive terminal for flowing an electric current to the electrode in 14 days after the start of the electrolysis. Further, when the $CF_4$ concentration of fluorine gas evolved was measured, it was found that the average $CF_4$ concentration was 500 pp or more (Comparative Example 2).

By contrast, the carbon electrode of Example 1 suffered no cracking for more than 3 months from the start of the electrolysis and the $CF_4$ concentration was constantly as low as not more than 20 ppm (Example 2).

EXAMPLE 3

A test sample of 250×70×15 mm was prepared from the carbon block produced in the same manner as in Example 1. Using the test sample as an anode and an iron plate as a cathode and using an electrolytic cell of 50 A scale, a constant-current electrolysis of an electrolytic bath containing a KF-2HF and $NH_4F$ was conducted at a bath temperature of 120° to 150° C. and at a current density of 5 A/dm$^2$.

In the electrolysis, a current efficiency of 70% was achieved, which was extremely high as compared to the current efficiency attained by the conventional electrolysis method using a nickel anode.

Further, the $CF_4$ concentration of the $NF_3$ evolved was as low as not greater than 500 ppm, and this means that $NF_3$ was produced with a purity which is extremely high as compared to that attained by the chemical method ($CF_4$ concentration: not smaller than 1000 ppm in general) which has been widely used commercially instead of the electrolysis method using a nickel electrode because the electrolysis using a nickel electrode is disadvantageous owing to the low current efficiency.

EXAMPLE 4

A calcined coke (calcined at 1200° to 1300° C.) having a mosaic structure in which the optically anisotropic regions (mosaic portions) have an average size of about 10 μm, was pulverized to a size of 325 mesh (Tyler)-pass or finer, to thereby obtain a base material. To 100 parts by weight of the pulverized coke as a base material was added 90 parts by weight of a coal-tar pitch as a binder and the resultant mixture was kneaded while heating at 180° to 220° C. The mixture was then pulverized to a size of 100 mesh (Tyler)-pass or finer, to obtain a molding powder. The molding powder was molded into a rectangular parallelepiped piped having a size of 125×250×75 mm by means of a metal mold under a molding pressure of 800 kg/cm$^2$. The molded material was heat-treated by elevating the temperature to 1000° C. at a temperature elevation rate of 2° C./hr to obtain a carbon block.

10 pieces of test samples each having a 10×10×60 mm size were cut out from the above-obtained carbon block.

These test samples were subjected to a 3-point flexural test in the same manner as in Example 1. As a result, it was found that the average flexural strength of the carbon block was as follows:

Example 4: 100 MPa

Further, a test sample of a size of 5×30×1 mm was cut out from the above carbon block. Using this test sample as an anode and using a Pt plate as a cathode and mercuric sulfate as a standard electrode, potential sweep was conducted in 18M concentrated sulfuric acid at 25° C. at a sweep rate of 5 mV/sec. to obtain a linear sweep voltammogram. As a result, a peak having a maximum current density and ascribed to the formation of a first-stage intercalation compound was observed at a potential of 1.4 V. Even when the carbon electrode was subjected to potential sweep 50 times from 0 to 1.5 V, no destruction of the electrode was observed.

EXAMPLE 5

A test sample having a size of 250×70×15 mm was cut out from the carbon block obtained in Example 4. Using the test sample as an anode and using iron as a cathode, constant-current electrolysis was conducted at a current density of 7 A/dm$^2$ in an electrolytic cell of 50A scale while strictly maintaining a bath temperature of 90° C. and a bath composition of KF-2HF. As a result, the carbon electrode suffered no cracking for more than 3 months after the start of the electrolysis, and the $CF_4$ concentration was constantly as low as not greater than 10 ppm.

EXAMPLE 6

Test samples each having a size of 250×70×15 mm were cut out from the carbon block obtained in Example 4. The test samples had a porosity of 7 to 8% and an average pore diameter of 1 μm or less. The test samples were, respectively, impregnated with the following metal fluoride systems: LiF, LiF+NaF (1:1 by mole), CsF+NaF (1:1 by mole), $AlF_3$+NaF (3:1 by mole), $MgF_2$, $CaF_2$ and $NiF_2$+NaF (2:1 by mole). The impregnation was effected by heating a metal fluoride (or mixture) to a temperature at which it was in a molten state and contacting a test sample with the molten metal fluoride (or mixture) under a superatmospheric pressure so that molten metal fluoride (or mixture) was introduced into the pores of the sample.

It was found that after the impregnation, the porosity of each test sample was zero, indicating that the pores of the test sample were completely filled with a metal fluoride (or mixture) (packing ratio: 100%). It was also found that after the impregnation, the flexural strength was 103 MPa, indicating that the impregnation had no adverse effect on the flexural strength, but improved the flexural strength.

EXAMPLE 7

Using the carbon electrode impregnated with a metal fluoride (or mixture) obtained in Example 6 as an anode and using an iron plate as a cathode, constant-current electrolysis was conducted at a current density of 7 A/dm$^2$ in an electrolytic cell of 50A scale while strictly maintaining a bath temperature of 90° C. and a bath composition of KF-2HF. In the electrolysis, the bath voltage was 0.5 to 1 V lower than in the case of a carbon electrode not impregnated with a metal fluoride, and the electrolysis was able to be stably conducted for more than 3 months. Further, the $CF_4$ concentration of the fluorine evolved was constantly not greater than 10 ppm.

What is claimed is:

1. A carbon electrode comprising a porous carbon block and having a flexural strength of at least 50 MPa and exhibiting, on a linear sweep voltammogram obtained by subjecting the carbon electrode to potential sweep in concentrated sulfuric acid at a sweep rate of 5 mV/sec. at 25° C., a peak having a maximum current density at a potential of at least 1.2 V relative to the potential of mercuric sulfate as a standard electrode.

2. The carbon electrode according to claim 1, further comprising, contained in pores of said carbon block, at least one metal fluoride selected from the group consisting of LiF, NaF, CsF, $AlF_3$, $MgF_2$, $CaF_2$ and $NiF_2$.

3. An apparatus for electrolyzing a hydrogen fluoride-containing molten salt, the apparatus comprising a cell and, disposed therein, an anode and a cathode, the anode including the carbon electrode as defined in claim 1 or 2.

4. A method for the electrolysis of a hydrogen fluoride-containing molten salt, comprising electrolyzing an electrolytic bath containing a hydrogen fluoride-containing molten salt using a carbon electrode as an anode, said carbon electrode comprising a porous carbon block and having a flexural strength of at least 50 MPa and exhibiting, on a linear sweep voltammogram obtained by subjecting the carbon electrode to potential sweep in concentrated sulfuric acid at a sweep rate of 5 mV/sec. at 25° C., a peak having a maximum current density at a potential of at least 1.2 V relative to the potential of mercuric sulfate as a standard electrode, and said hydrogen fluoride-containing molten salt being of a KF-HF system, a CsF-HF system, an NOF-HF system, a KF-$NH_4F$-HF system or an $NH_4F$-HF system.

5. A method as defined in claim 4 wherein the carbon electrode further comprises, contained in pores of said carbon block, at least one metal fluoride selected from the group consisting of LiF, NaF, CsF, $AlF_3$, $MgF_2$, $CaF_2$ and $NiF_2$.

* * * * *